US005520498A

United States Patent [19]

DiBartolomeo

[11] Patent Number: 5,520,498

[45] Date of Patent: May 28, 1996

[54] PORTABLE AND COLLAPSIBLE HOISTING APPARATUS BEING ATTACHABLE TO A CONVENTIONAL VEHICLE RECEIVER HITCH

[76] Inventor: John DiBartolomeo, 620 Brunswick Pke., Lambertville, N.J. 08530

[21] Appl. No.: 317,008

[22] Filed: Oct. 3, 1994

[51] Int. Cl.[6] ..... B66F 19/00

[52] U.S. Cl. ..... 414/680; 212/180; 212/306; 414/550

[58] Field of Search ..... 414/680, 540, 414/550, 563, 591; 212/180, 306, 901

[56] References Cited

U.S. PATENT DOCUMENTS

| | | | |
|---|---|---|---|
| 3,145,857 | 8/1964 | Hayman et al. . | |
| 3,310,186 | 3/1967 | Wegener et al. . | |
| 3,650,421 | 3/1972 | Miller | 414/550 X |
| 4,190,233 | 2/1980 | Godfrey . | |
| 4,381,069 | 4/1983 | Kreck . | |
| 4,479,632 | 10/1984 | McIntire et al. . | |
| 4,534,588 | 8/1985 | Markey . | |
| 4,749,324 | 6/1988 | Rulisen | 414/680 X |
| 4,901,896 | 2/1990 | Speer . | |
| 5,009,445 | 4/1991 | Williams, Jr. . | |
| 5,052,880 | 10/1991 | Ross . | |
| 5,064,078 | 11/1991 | Van Staveren | 212/901 X |
| 5,106,114 | 4/1992 | Haupt . | |
| 5,211,526 | 5/1993 | Robinette | 212/306 X |

OTHER PUBLICATIONS

Flyer—Sky Hook™ SNT Merchants of Speed P.O. Box 486, Red Bank, NJ 07001 (Sky Hook Engine Hoisting Device).

*Primary Examiner*—Donald W. Underwood
*Attorney, Agent, or Firm*—Sperry, Zoda & Kane

[57] ABSTRACT

A lightweight, portable hoisting apparatus which is easily securable into a standard receiver hitch of a truck or other vehicle which can be used for hoisting heavy objects such as motor vehicle engines and the like, a vertically extendable main support member preferably formed of box tubing is included which is obliquely oriented with respect to the ground at 70–90 degrees. A mounting head is slidably engageable with respect to the lower portion of the main support member and includes a mounting housing defining a vertical channel therein for receiving the main support member and a mounting arm extending outwardly to engage the vehicle hitch. A boom arm is pivotally mounted to the upper end of the main support member and includes a load attachment means preferably at the outermost end thereof. Powering of the boom arm is achieved by a cylinder or other similar longitudinally extendable means which is pivotally secured at an intermediate location with respect to the main support member as well as being pivotally secured at an intermediate location with respect to the boom arm. The mounting arm may be angularly oriented with respect to the mounting head to orient the main support member obliquely with respect to the ground.

19 Claims, 2 Drawing Sheets

PORTABLE AND COLLAPSIBLE HOISTING APPARATUS BEING ATTACHABLE TO A CONVENTIONAL VEHICLE RECEIVER HITCH

BACKGROUND OF THE INVENTION

1. Field of the Invention

The present invention deals with the field of devices for lifting heavy objects often used in the automotive field. Normally such heavy duty hoists are used for removal and replacement of an automotive engine from a vehicle engine compartment. Such a removal normally requires vertical movement of such a heavy load for a significant distance in order to clear the fenders and/or front grill of such a vehicle. Many different types of engine hoists and engine lifts have been designed. However, the present invention provides a novel lightweight and yet heavy duty hoisting design which can be easily disassembled and assembled and is capable of mounting to a standard or conventional receiver hitch attachment normally used for towing by vehicles, especially.

2. Description of the Prior Art

Numerous configurations have been patented for the purpose of providing the necessary power for hoisting or lifting of such heavy loads such as shown in U.S. Pat. No. 3,145,857 patented Aug. 25, 1964 to M. Hayman et al and assigned to Hellenga and Paul E. Hicks on a "Mobile Lift Crane And Vehicle Tow Hoist"; and U.S. Pat. No. 3,310,186 patented Mar. 21, 1967 to E. F. Wegener et al on a "Vehicle Lifting And Towing Apparatus"; and U.S. Pat. No. 4,190,233 patented Feb. 26, 1980 to C. Godfrey on a "Jack"; and U.S. Pat. No. 4,381,069 patented Apr. 26, 1983 to S. Kreck on an "Outboard Motor Carrier For Motor Vehicle"; and U.S. Pat. No. 4,479,632 patented Oct. 30, 1984 to R. McIntire et al on a "Dolly For An Automotive Engine"; and U.S. Pat. No. 4,534,588 patented Aug. 13, 1985 to J. Markey on an "Engine LIfting Tool"; and U.S. Pat. No. 4,901,896 patented Feb. 20, 1990 to W. Speer on an "Apparatus For Connecting Article Carriers To A Trailer Hitch Ball"; and U.S. Pat. No. 5,009,445 patented Apr. 23, 1991 to T. Williams, Jr. on a "Trailer Hitch Cable Puller"; and U.S. Pat. No. 5,052,880 patented Oct. 1, 1991 to K. Ross on a "Vehicle Hoisting Tow Trailer"; and U.S. Pat. No. 5,106,114 patented Apr. 21, 1992 to E. Haupt on a "Multiple Rear Bumper Hitch Apparatus".

SUMMARY OF THE INVENTION

The present invention provides a hoisting apparatus which is portable and collapsible and yet heavy duty. The hoisting apparatus of the present invention is attachable to a standard vehicle receiver hitch when assembled. The basic design includes a main support member extending generally in a vertical direction with the upper end angled back toward the vehicle for added strength and normally being formed of box tubing for further strengthening thereof. The main support member can be positioned in abutment with the surrounding ground area for added strength if needed. The main support member includes a main support lower end area for attachment of the mounting device with respect to the vehicle hitch as well as a main support upper end area for detachable securement of a boom thereon.

A mounting head for holding the main support member vertically with respect to a vehicle hitch may be detachably secured to the main support member in the main support lower end area as described above. This mounting head preferably includes a mounting housing which defines a mounting channel extending therethrough which is preferably of rectangular cross-section to facilitate retaining of the box tubing of the main support member extending therethrough. This main housing should define this mounting channel in a generally vertical direction or at approximately 70 degrees to 90 degrees such as to be adapted to receive the main support member extending therethrough for adjustable sliding securement therewith. The angled inclination allows the upper end to be canted toward the vehicle to increase the strength parameters of the assembled hoisting apparatus.

The mounting head further includes a mounting arm secured to the mounting housing which extends outwardly therefrom at approximately 70–90 degrees to be detachably securable with respect to a conventionally configured vehicle receiver hitch. As shown in the drawings, such a conventional receiver hitch normally includes a tubular member which is adapted to receive the mounting arm therein. A securement means is preferably included in the mounting head which is adapted to detachably secure the main support member with respect to the mounting channel of the mounting housing through which the main support member extends. Preferably this lower securement device will include one or more individual set screw means threaded into the main housing and into the mounting channel in order to abut the main support member for biasing thereagainst and holding it in a desired position within the mounting channel.

A knee brace can be fixedly secured to the mounting housing and to the mounting arm for strengthening thereof as it extends outwardly and somewhat upwardly from the mounting housing.

A boom arm is preferably pivotally secured to the main support upper end area such as to extend outwardly therefrom. This boom arm is preferably made also of a box tubing material for added strength. A load attachment device can also be included secured to the boom arm at a location near the outer end thereof spatially disposed from the main support member. This load attachment device preferably is securable to a load to be hoisted to urge movement thereof responsive to movement of the boom arm. The load attachment means preferably includes a flexible chain member as well as a hook device.

A cylinder mounting bracket may be pivotally mounted to the main support member at an intermediate position thereon below boom arm and above the mounting head. This cylinder mounting bracket facilitates the positioning of the longitudinally extensible member such as a hydraulic cylinder. This hydraulically powered cylinder can be mounted onto the cylinder mounting bracket to thereby facilitate pivotal movability with respect to the main support member. The cylinder member is also preferably pivotally secured with respect to the boom arm at an intermediate position thereon between the location of the load attachment device and the main support member in order to facilitate movement of the boom arm up and down for lifting and lowering of a load as desired.

A first boom pivotal connecting device may be mounted on the boom arm which includes a first and second boom ear member spatially disposed from one another with the main support upper area positioned therebetween. A first boom pin can then extend through both of these ears and through the upper portion of the main support member to facilitate pivotal mounting of the boom arm with respect to the main support member.

In a similar configuration a second boom pivotal connecting device may be included which includes two ear members extending downwardly from the boom arm adjacent the upper end of the cylinder with the upper end of the longitudinally extensible cylinder positioned between these ears. A second boom pin can then extend through the two ears and through the upper end of the cylinder member for achieving pivotal securement between the boom arm and the extensible cylinder member.

Another similar construction is included in the main support pivotal connecting device which includes a main support primary ear and a main support secondary ear both fixedly secured to the main support member adjacent to the lower end of the cylinder member or the lower end of the cylinder mounting bracket if used. A main support pin can extend through the two main support ear members and through the cylinder mounting bracket or the lower end of the longitudinally extensible device in order to achieve pivotal securement between the longitudinal extensible device and the main support member.

It is an object of the present invention to provide a portable and collapsible hoisting apparatus which is attachable to a conventional vehicle receiver hitch which is can easily plug into any truck or other vehicle hitch.

It is an object of the present invention to provide a portable and collapsible hoisting apparatus which is attachable to a conventional vehicle receiver hitch which is relatively inexpensive and yet sturdy.

It is an object of the present invention to provide a portable and collapsible hoisting apparatus which is attachable to a conventional vehicle receiver hitch which is lightweight to facilitate usage.

It is an object of the present invention to provide a portable and collapsible hoisting apparatus which is attachable to a conventional vehicle receiver hitch which includes a minimal number of moving parts.

It is an object of the present invention to provide a portable and collapsible hoisting apparatus which is attachable to a conventional vehicle receiver hitch which can handle all sizes of vehicle engines.

It is an object of the present invention to provide a portable and collapsible hoisting apparatus which is attachable to a conventional vehicle receiver hitch which can have a handling capacity of as much as 1500 lbs.

It is an object of the present invention to provide a portable and collapsible hoisting apparatus which is attachable to a conventional vehicle receiver hitch which can conveniently break down for easy storage.

It is an object of the present invention to provide a portable and collapsible hoisting apparatus which is attachable to a conventional vehicle receiver hitch which provides an economical way of changing engines at remote locations.

It is an object of the present invention to provide a portable and collapsible hoisting apparatus which is attachable to a conventional vehicle receiver hitch which provides an economical way of changing engines within engine shop.

It is an object of the present invention to provide a portable and collapsible hoisting apparatus which is attachable to a conventional vehicle receiver hitch which easily breaks into two pieces for easy storage and takes up very little room in a trailer or shop.

It is an object of the present invention to provide a portable and collapsible hoisting apparatus which is attachable to a conventional vehicle receiver hitch which can fit all types of vans or jeeps or any type of vehicle.

It is an object of the present invention to provide a portable and collapsible hoisting apparatus which is attachable to a conventional vehicle receiver hitch which is made from extremely strong box tubing stock.

It is an object of the present invention to provide a portable and collapsible hoisting apparatus which is attachable to a conventional vehicle receiver hitch which can be assembled or disassembled in minutes.

It is an object of the present invention to provide a portable and collapsible hoisting apparatus which is attachable to a conventional vehicle receiver hitch which allows abutting positioning of the main support member with respect to the ground area by adjustment screws provided on the mounting head if such additional strength is required.

It is an object of the present invention to provide a portable and collapsible hoisting apparatus which is attachable to a conventional vehicle receiver hitch which allows variable positioning of the boom member by adjustable vertical positioning of the mounting head along the main support member.

It is an object of the present invention to provide a portable and collapsible hoisting apparatus which is attachable to a conventional vehicle receiver hitch which allows easy replacement of a cylinder by use of a convenient cylinder mounting bracket.

It is an object of the present invention to provide a portable and collapsible hoisting apparatus which is attachable to a conventional vehicle receiver hitch which allows use of a conventional hydraulic jacking device as the power cylinder means as desired.

It is an object of the present invention to provide a portable and collapsible hoisting apparatus which is attachable to a conventional vehicle receiver hitch which can allow very high vertical heights of movement of a vehicle engine due to the vertically movable and vertically adjustable boom arm configuration.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 2:
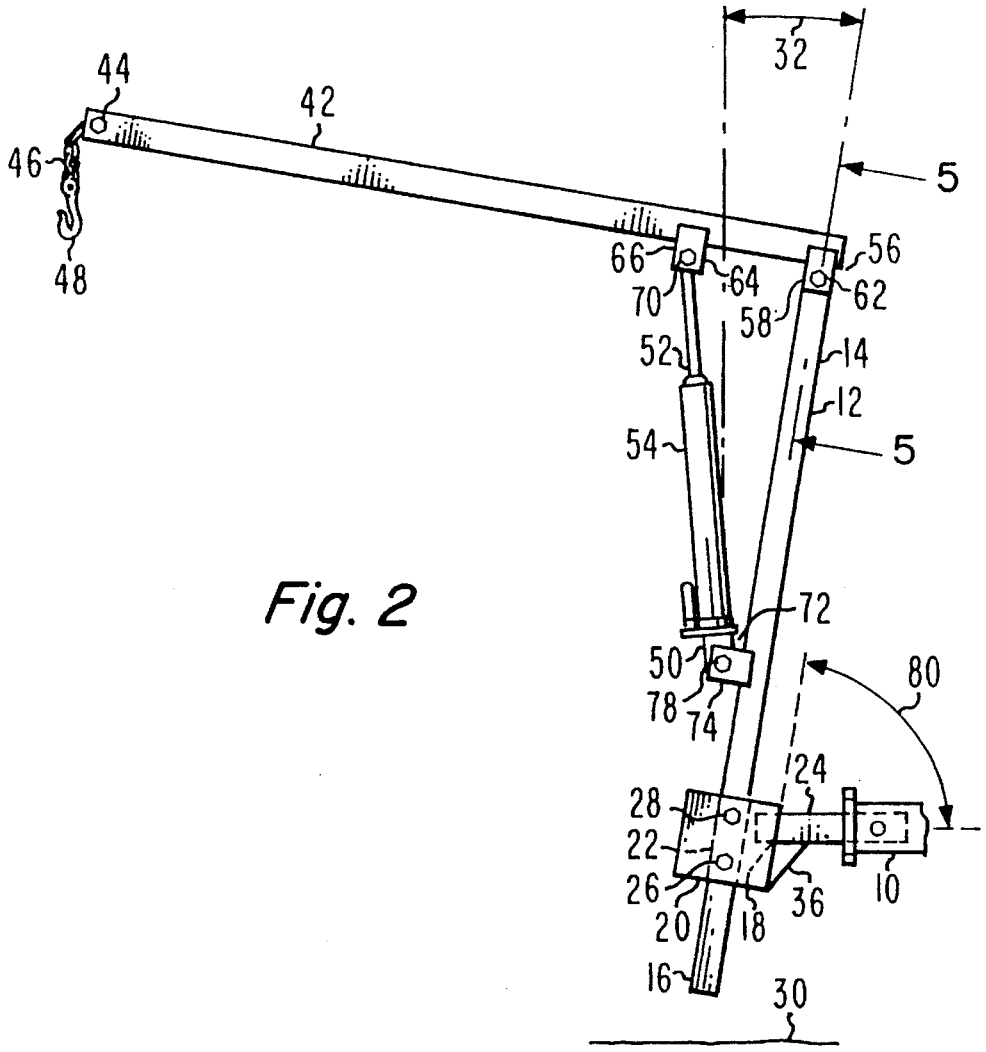
FIG. 2 is a side plan view of the configuration shown in FIG. 1.
Figure 1:
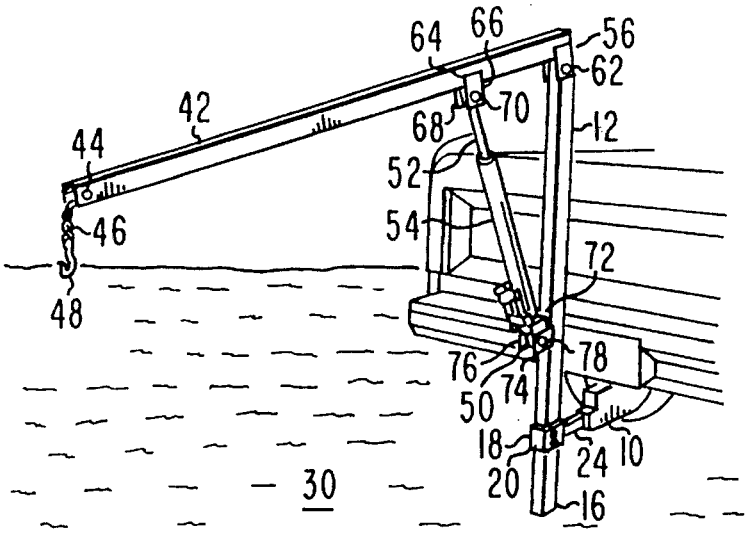
FIG. 1 is a three-quarter perspective illustration of an embodiment of the portable and collapsible hoisting apparatus attachable to a conventional vehicle receiver hitch of the present invention.

The present invention provides a novel configuration for a hoisting apparatus which is attachable to a conventional vehicle receiver hitch 10 often found on the rear portion of vehicles such as utility vehicles, trucks and the like. The hoisting apparatus of the present invention is designed to be easily collapsible such that it is portable and conveniently stored in between times of usage.

The configuration of the hoisting apparatus of the present invention includes a main support member 12 extending upwardly which is preferably formed of a box tubing configuration for enhancing strength thereof. This main support member 12 will include a main support upper area 14 and a main support lower area 16.

A mounting head 18 is adapted to be slidably engageable with the lower end area 16 of the main support member 12. Mounting head 18 includes a mounting housing 20 as well as a mounting channel 22 extending vertically therethrough. Preferably this mounting channel 22 is of a rectangular configuration designed to accept the box tubing of the main support member 12 extending therethrough to allow selective securement and adjustable positioning and to prevent axial rotation of the main support member 12 when extending therethrough. A securement means 26 such as one or more set screws 28 are preferably mounted within main support housing 12 to extend therethrough into the mounting channel 22 to be directly engageable or in abutment with the main support member 12 extending therethrough for fixedly securing the mounting head 18 with respect to the main support member 12. In the embodiment shown in the drawings, two such set screws are included.

Figure 3:
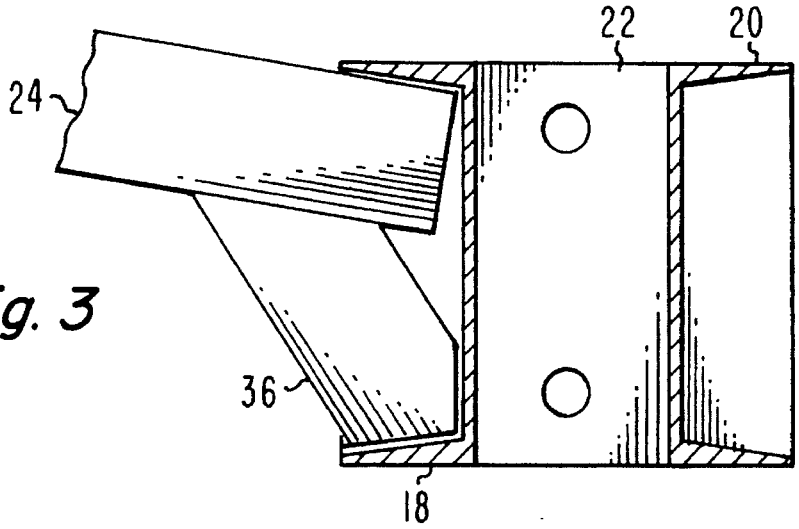
FIG. 3 is a side cross sectional view of an embodiment of the mounting head of the present invention.
Figure 4:
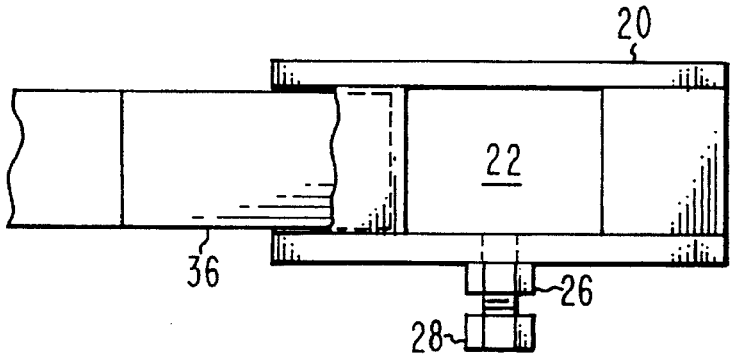
FIG. 4 is a top plan view of the embodiment of the mounting head as shown in FIG. 3.
Figure 5:
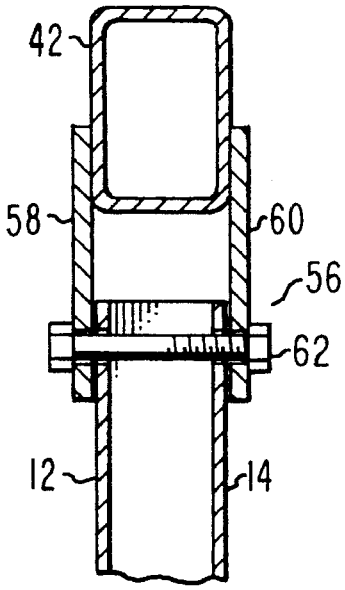
FIG. 5 is a cross sectional view of the embodiment shown in FIG. 2 taken along lines 5—5.

The mounting arm 24 can be further held in position fixedly by a knee brace 36 as shown best in FIG. 3. The knee brace 36 is preferably welded to the mounting housing 20 as well as welded directly to the mounting arm 24 extending outwardly therefrom for significant strengthening of the mounting head 18 and orientation of mounting arm 24 angularly oblique with respect thereto.

A boom arm means 42 may be pivotally mounted to the main support member upper end area 14. The boom arm 42 is the primary vertical movable member of the apparatus of the present invention used to achieve lifting motion for the hoisting apparatus. At a point near the outermost end of the boom arm 42 a load attachment device 44 may be included. This load attachment device 44 will preferably include a flexible chain 46 as well as preferably a hooking device 48 to facilitate attachment with respect to various different types of loads.

Movement of the boom arm means 42 is achieved by powered movement of a longitudinally extensible member 52. This member can be of any conventional design. However, for the purposes of this specific embodiment, the longitudinally extensible member 52 will comprise a hydraulically powered cylinder means 54. Any type of cylinder can be used whether it is pneumatically powered, hydraulically powered or otherwise. However, for the purpose of the present invention and for use in remote locations, a hydraulically powered cylinder 54 is deemed to be most convenient for this specific design shown in the preferred embodiment. The hydraulically powered cylinder 54 is pivotally mounted with respect to the boom arm 42 at an intermediate position thereon between the main support upper end area and the load attachment device 44. At the opposite end the hydraulically powered cylinder 54 is pivotally secured with respect to the main support member 12 at an intermediate position. With this configuration, powered extending and retracting of the cylinder means 54 will achieve vertical up and down movement of the boom arm 42 thereby allowing for hoisting and lowering of a load as desired. To facilitate mounting of the hydraulic cylinder 54 with respect to the main support member 12, a cylinder mounting bracket 50 may be included. This cylinder mounting bracket 50 itself is designed to be pivotally mounted with respect to the main support member 12 and is adapted to be fixedly but detachably mounted with respect to the lower end of the hydraulically powered cylinder 54. With this configuration the replacement of the hydraulic cylinder 54 can be easily achieved.

The mounting arm 24 will preferably extend outwardly and somewhat upwardly from the main support member 12. Preferably the axis of the mounting arm 24 will be at an angle of 70 to 90 degrees from vertical in order to orient the main support upper end area rearwardly toward the vehicle and the main support lower end area forwardly away from the vehicle with respect to one another. In this manner the main support member 12 is be slightly angled and somewhat further strengthened. Further stability can be achieved, if desired, by adjusting of the main support member 12 within the mounting channel 22 of the mounting housing 20 such that the lowermost end of the main support lower end area is in direct abutment with the adjacent ground area. This added strength will only be needed when hoisting very significant loads.

To facilitate operation of the design of the apparatus of the present invention a first boom pivotal connecting means 56 may be included which includes a first boom primary ear member 58 and a first boom secondary ear member 60 both being fixedly secured to the portion of the boom immediately adjacent to the main support upper end area 14. These two ear members 58 and 60 will be spaced apart from one another such as to receive therebetween the upper end of the main support member 12. A first boom pin 62 will then extend through the first boom primary ear member 58 and then through the main support upper end area 14 and then through the first boom secondary ear member 60 in such a manner as to engage those parts with respect to one another and yet allow relative pivotal movement.

In a similar fashion a second boom pivotal securement means 64 may be included which includes a second boom primary ear member 66 and a second boom secondary ear member 68 spaced from one another but both fixedly secured to the boom arm 42 and extending downwardly therefrom. These ear members 66 and 68 will be spaced apart from one another such as to receive therebetween the upper end of the hydraulically powered cylinder 54. A second boom pin 70 will then extend through the ear 66, the upper end of the cylinder 54 and then the ear 68 to allow pivotal engagement therebetween.

Another similar configuration can be used as the main support pivotal securement means 72. This main support pivotal securement configuration will include a main support primary ear 74 and a main support secondary ear 76 both fixedly secured to and extending outwardly from the main support member 12. The two ears 74 and 76 will be slightly spaced from one another in order to receive therebetween the lower end of the hydraulically powered cylinder 54 or, when included, the lower end of the cylinder mounting bracket 50. As such, pivotal movement of the so used piece with respect to the main support shaft 12 will be achieved by passing of a main support pin 78 through the ears 74 and 76 and through the lower end of the cylinder mounting bracket 50 or the cylinder means 54 itself. With either configuration full pivotal movement of the cylinder 54 with respect to the main support member 12 is achieved to facilitate vertical movement of the hoisting apparatus of the present invention.

The apparatus of the hoisting apparatus of the present invention is easily disassembled and stored as desired. This ease of disassembly is achieve by removal of the pins 62 and 70 thereby completely releasing the boom arm means 42. The cylinder member 54 can then be collapsed to a position immediately adjacent said main support member. The securement means 26 can be loosened thereby allowing the main support member 12 to be released from the mounting channel 22. Mounting head 18 can then be easily removed from engagement with the receiver hitch 10. With such disassembly, the apparatus of the present invention is not easily transportable as desired.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A portable and collapsible hoisting apparatus being attachable to a conventional vehicle receiver hitch comprising:

A. a main support member extending generally vertically and including a main support upper end area and a main support lower end area;

B. a mounting head located on said main support member adjacent said main support lower end area to facilitate mounting thereof with respect to a conventional vehicle receiver hitch, said mounting head including:

(1) a mounting housing means defining a mounting channel means extending generally upwardly therethrough and being adapted to receive said main support member extending therethrough for mounting thereon adjustably, said mounting channel means being open at its opposite ends to permit said main support member to pass therethrough to abut the environmental ground area to facilitate strengthening thereof;

(2) a securement means adapted to engage said main support member extending through said mounting channel means for detachably securing said mounting housing means with respect thereto;

(3) a mounting arm means secured to said mounting housing means and extending outwardly therefrom to be detachably securable to a conventional vehicle receiver hitch;

C. a boom arm means pivotally secured to said main support upper end area of said main support member and extending outwardly therefrom;

D. a load attachment means attached to said boom arm means at a location spatially disposed from said main support member, said load attachment means being detachably securable to a load to be hoisted to urge movement thereof responsive to movement of said boom arm means; and E. a longitudinally extensible means pivotally secured to said main support member at an intermediate position thereon below said boom arm means and above said mounting head, said longitudinally extensible means also being pivotally secured to said boom arm means at an intermediate position thereon between said load attachment means and said main support member to facilitate vertical movement of said boom arm means responsive to extension and contraction of said longitudinally extensible means, said load attachment means and a load attached thereto being responsive to longitudinally extending and retracting movement of said longitudinally extensible means to move vertically downwardly and upwardly.

2. A portable and collapsible hoisting apparatus being attachable to a conventional vehicle receiver hitch as defined in claim 1 wherein said main support member comprises a box tubing member for strengthening thereof.

3. A portable and collapsible hoisting apparatus being attachable to a conventional vehicle receiver hitch as defined in claim 2 wherein said mounting channel means is rectangular to receive the box tubing of said main support member extending therethrough to prevent axial rotation thereof.

4. A portable and collapsible hoisting apparatus being attachable to a conventional vehicle receiver hitch as defined in claim 1 wherein said longitudinally extensible means comprises a powered cylinder member operable to control movement of said boom arms means.

5. A portable and collapsible hoisting apparatus being attachable to a conventional vehicle receiver hitch as defined in claim 4 wherein said powered cylinder member comprises a hydraulic cylinder member.

6. A portable and collapsible hoisting apparatus being attachable to a conventional vehicle receiver hitch as defined in claim 4 further comprising a cylinder mounting bracket being detachably secured to said powered cylinder member immediately adjacent said main support member, said cylinder mounting bracket being pivotally mounted to said main support member to facilitate pivotal movement of said powered cylinder member with respect to said main support member.

7. A portable and collapsible hoisting apparatus being attachable to a conventional vehicle receiver hitch as defined in claim 1 wherein said mounting arm means is secured to said mounting housing means in a position extending upwardly and outwardly therefrom to orientate said main support member at an oblique angle.

8. A portable and collapsible hoisting apparatus being attachable to a conventional vehicle receiver hitch as defined in claim 7 further including a knee brace fixedly secured to said mounting housing means and to said mounting arm means for strengthening of said mounting arm means extending upwardly and outwardly therefrom.

9. A portable and collapsible hoisting apparatus being attachable to a conventional vehicle receiver hitch as defined in claim 1 further comprising a securement means positioned adjacent said mounting channel means for detachably securing of said mounting housing means with respect to said main support member extending through said mounting channel means thereof and for allowing adjustable positioning vertically therebetween.

10. A portable and collapsible hoisting apparatus being attachable to a conventional vehicle receiver hitch as defined in claim 9 wherein said securement means comprises at least one set screw means extending through said mounting housing means into said mounting channel means for abutment with respect to said main support member extending therethrough for detachable securement therewith.

11. A portable and collapsible hoisting apparatus being attachable to a conventional vehicle receiver hitch as defined in claim 1 wherein said main support member is obliquely angled at approximately at 70 degrees to 90 degrees inclination.

12. A portable and collapsible hoisting apparatus being attachable to a conventional vehicle receiver hitch as defined in claim 1 wherein said boom arm means is made of box tubing material.

13. A portable and collapsible hoisting apparatus being attachable to a conventional vehicle receiver hitch as defined in claim 1 further including a first boom pivotal connecting means mounted on said main support upper end area comprising:

A. a first boom primary ear member fixedly secured to said boom arm means adjacent said main support upper end area and extending downwardly therefrom;

B. a first boom secondary ear member fixedly secured to said boom arm means and extending downwardly therefrom adjacent said main support upper end area spatially disposed from said first boom primary ear member with said main support member positioned therebetween; and C. a first boom pin means extending through said first boom primary ear member, said main support member and said first boom secondary ear member for facilitating pivotally moveable engagement therebetween.

14. A portable and collapsible hoisting apparatus being attachable to a conventional vehicle receiver hitch as defined in claim 13 further including a second boom pivotal connecting means mounted on said boom arm means comprising:

A. a second boom primary ear member fixedly secured to said boom arm means and extending downwardly therefrom adjacent said longitudinally extensible means;

B. a second boom secondary ear member fixedly secured to said boom arm means and extending downwardly therefrom adjacent said longitudinally extensible means spatially disposed from said second boom primary ear member with said longitudinally extensible means positioned therebetween; and C. a second boom pin means extending through said second boom primary ear member, said longitudinally extensible means and said second boom secondary ear member for facilitating pivotally moveable engagement therebetween.

15. A portable and collapsible hoisting apparatus being attachable to a conventional vehicle receiver hitch as defined in claim 1 further including a main support pivotal connecting means mounted on said main support member comprising:

A. a main support primary ear member fixedly secured to said main support member and extending outwardly therefrom adjacent said longitudinally extensible means;

B. a main support secondary ear member fixedly secured to said main support member and extending outwardly therefrom adjacent said longitudinally extensible means spatially disposed from said main support primary ear member with said longitudinally extensible means positioned therebetween; and C. a main support pin means extending through said main support primary ear member, said longitudinally extensible means and said main support secondary ear member for facilitating pivotally moveable engagement therebetween.

16. A portable and collapsible hoisting apparatus being attachable to a conventional vehicle receiver hitch as defined in claim 1 wherein said load attachment means includes a flexible chain means to facilitate support of a load therefrom.

17. A portable and collapsible hoisting apparatus being attachable to a conventional vehicle receiver hitch as defined in claim 16 further including a hook means attached to said flexible chain means to further facilitate attachment of a load thereto.

18. A portable and collapsible hoisting apparatus being attachable to a conventional vehicle receiver hitch as defined in claim 7 wherein said mounting arm means extending upwardly and laterally outwardly from main support member at an angle of 70 to 90 degrees with respect thereto.

19. A portable and collapsible hoisting apparatus being attachable to a conventional vehicle receiver hitch comprising:

A. a main support member extending generally upwardly and including a main support upper end area and a main support lower end area, said main support member being formed of box tubing for facilitating strengthening thereof;

B. a mounting head positioned on said main support member adjacent said main support lower end area thereof to facilitate mounting thereof with respect to a conventional vehicle receiver hitch, said mounting head further including:

(1) a mounting housing means defining a mounting channel means extending generally vertically therethrough and being adapted to receive said main support member extending therethrough for moveable mounting thereon, said mounting channel means being open at its opposite ends to permit said main support member to pass therethrough to abut the environmental ground area to facilitate strengthening thereof, said mounting channel means being of rectangular cross-sectional shape to facilitate receiving of said main support member therein and for preventing axial rotation thereof;

(2) a mounting arm means secured to said mounting housing means and extending outwardly and upwardly therefrom to be detachably securable to a conventional vehicle receiver hitch, said mounting arm extending upwardly to orient said main support member obliquely with said main support upper end area inclined toward the vehicle;

(3) a securement means positioned adjacent said mounting channel means for detachably securing of said mounting housing means with respect to said main support member extending through said mounting channel means and for allowing adjustable positioning vertically therebetween, said securement means comprises at least one set screw means extending through said mounting housing means into said mounting channel means for abutment with respect to said main support member extending therethrough for adjustable securement therewith;

(4) a knee brace fixedly secured to said mounting housing means and to said mounting arm means for strengthening thereof extending upwardly and outwardly from said mounting housing means;

D. a boom arm means pivotally secured to said main support upper end area of said main support member arm means extending outwardly therefrom, said boom arm means being made of box tubing material;

E. a load attachment means attached to said boom arm means at a location spatially disposed from said main support member, said load attachment means being detachably securable to a load to be hoisted to urge movement thereof responsive to movement of said boom arm means, said load attachment means including a flexible chain means and a hook means;

F. a cylinder mounting bracket being pivotally mounted to said main support member at an intermediate position thereon above said mounting head;

G. a longitudinally extensible means fixedly mounted to said cylinder mounting bracket to be pivotally secured with respect to said main support member, said longitudinally extensible means also being pivotally secured to said boom arm means at an intermediate position thereon between said load attachment means and said main support member to facilitate vertical movement of said boom arm means, said load attachment means and a load attached thereto being vertically moveable responsive to longitudinally extending and retracting movement of said longitudinally extensible means, said longitudinally extensible means being a hydraulic powered cylinder member;

H. a first boom pivotal connecting means mounted on said boom arm means comprising:

(1) a first boom primary ear member fixedly secured to said boom arm means and extending downwardly therefrom adjacent said main support upper end area;

(2) a first boom secondary ear member fixedly secured to said boom arm means and extending downwardly therefrom adjacent said main support upper end area spatially disposed from said first boom primary ear member with said main support member positioned therebetween;

(3) a first boom pin means extending through said first boom primary ear member, said main support member upper area and said first boom secondary ear member for facilitating pivotally moveable engagement therebetween;

I. a second boom pivotal connecting means mounted on said boom arm means comprising:

(1) a second boom primary ear member fixedly secured to said boom arm means and extending downwardly therefrom adjacent said longitudinally extensible means;

(2) a second boom secondary ear member fixedly secured to said boom arm means and extending downwardly therefrom adjacent said longitudinally extensible means spatially disposed from said second boom primary ear member with said longitudinally extensible means positioned therebetween;

(3) a second boom pin means extending through said second boom primary ear member, said longitudinally extensible means and said second boom secondary ear member for facilitating pivotally moveable engagement therebetween;

J. a main support pivotal connecting means mounted on said main support member comprising:

(1) a main support primary ear member fixedly secured to said main support member and extending outwardly therefrom adjacent said longitudinally extensible means;

(2) a main support secondary ear member fixedly secured to said main support member and extending outwardly therefrom adjacent said longitudinally extensible means spatially disposed from said main support primary ear member with said cylinder mounting bracket positioned therebetween; and (3) a main support pin means extending through said main support primary ear member, said cylinder mounting bracket and said main support secondary ear member for facilitating pivotally moveable engagement therebetween.

* * * * *